United States Patent [19]

Rignon et al.

[11] Patent Number: 4,678,549

[45] Date of Patent: Jul. 7, 1987

[54] PROCESS FOR MAKING AMINO ALCOHOLS BY ELECTROCHEMICAL REDUCTION OF NITRO ALCOHOLS

[75] Inventors: Maurice Rignon, Givry; Jean-Claude Catonne, La-Celle-Saint-Cloud; Francoise Denisard, Elancourt; Jean Malafosse, Saint Marcel, all of France

[73] Assignee: l'Air Liquide, Societe Anonyme Pour l'Etude et l'Exploitation des Procédés Georges Claude, Paris, France

[21] Appl. No.: 828,558

[22] Filed: Feb. 10, 1986

[30] Foreign Application Priority Data

Feb. 11, 1985 [FR] France ..... 85 01873

[51] Int. Cl.[4] ..... C25B 3/04; B01D 13/02

[52] U.S. Cl. ..... 204/74; 204/182.4; 204/182.6

[58] Field of Search ..... 204/74, 180.1, 182.4, 204/182.6

[56] References Cited

U.S. PATENT DOCUMENTS

| | | | |
|---|---|---|---|
| 2,485,982 | 10/1949 | McMillan | 204/74 |
| 2,589,635 | 3/1952 | Smith | 204/74 |
| 3,338,806 | 8/1967 | Harwood | 204/74 |
| 3,645,864 | 2/1972 | Lawson et al. | 204/74 |
| 4,396,474 | 8/1983 | Astruc et al. | 204/74 |
| 4,584,069 | 4/1986 | Lessard et al. | 204/74 |
| 4,584,070 | 4/1986 | DeLue et al. | 204/74 |

FOREIGN PATENT DOCUMENTS

| | | | |
|---|---|---|---|
| 2256003 | 6/1973 | Fed. Rep. of Germany | 204/74 |
| 1166363 | 10/1969 | United Kingdom | 204/74 |
| 1421118 | 1/1976 | United Kingdom | 204/74 |

*Primary Examiner*—John F. Niebling
*Assistant Examiner*—Terryence Chapman
*Attorney, Agent, or Firm*—Browdy and Neimark

[57] ABSTRACT

A process for producing amino alcohols by electrosynthesis of nitro alcohols.

Reduction of the nitro group is performed in three stages on a cathode made of a material having a strong hydrogen overpotential. During the second stage of reduction, the electronegative potential is higher, and in the last stage the sulfuric solution of amino alcohol obtained is subjected to a purification operation by electro-electrodialysis (EED), followed by an elimination of water.

The process is particularly useful for the production of 2-nitro-2-methyl-1-propanol, 2-nitro-2-methyl-1, 3-propanediol, 2-nitro-2-ethyl-1, 3-propanediol, 2-nitro-1-butanol, tris(hydroxymethyl) nitromethane.

13 Claims, 5 Drawing Figures

PROCESS FOR MAKING AMINO ALCOHOLS BY ELECTROCHEMICAL REDUCTION OF NITRO ALCOHOLS

FIELD OF THE INVENTION

The present invention relates to the production of amino alcohols by electrochemical reduction of nitro alcohols.

BACKGROUND OF THE INVENTION

Nitro alcohols are derivatives easily obtained by addition of formaldehyde to nitroparaffins. Several processes have been described to transform them into amino alcohols (alkanolamines) used in the production of cosmetics, detergents or as intermediaries for synthesis of bactericides and pharmaceutical products.

The $—NO_2$ group can be reduced by the Fe-Fe++ pair in sulfuric or acetic acid medium, but the weight of reagent used is about three times that of the nitro derivatives to be reduced; a large quantity of solid residue to be eliminated results and it is necessary to rectify the liquid phase containing the amine to obtain a pure product; the yield is on the order of 80%.

A catalytic hydrogenenation can also be performed, for example on Raney nickel in a methanol medium under 60 bars pressure at 40°–45° C. In this case, too, the yield does not exceed 80%; the secondary reactions are numerous, causing the formation of light amines and heavy residue that must be separated from the desired amino alcohol by several successive rectifications which necessitate a large investment and a considerable consumption of energy. On the other hand, the formation of $N—CH_3$ derivative cannot be avoided, which is then difficult to separate from the desired amino derivative.

An electrochemical reduction process has already been described in U.S. Pat. No. 2,485,982 according to which the operation is in a hydrochloric or sulfuric aqueous solution in an electrochemical cell equipped with a porous porcelain diaphragm. An aqueous solution of hydrochlorides or of sulfate of amino alcohol is obtained that must then be neutralized and/or precipitated to obtain the amine. In addition to the raw material nitro derivative, the acid and the reagents for neutralizing and precipitating are consumed that must then be discharged into the environment.

A reduction process by electrochemical means in a sulfuric acid medium has been sought making it possible to obtain on the one hand a concentrated aqueous solution of pure amino alcohol and on the other hand sulfuric acid solutions that can be reused in the following operation.

SUMMARY OF THE INVENTION

It is an object of the present invention to provide an electrochemical means for making pure amino alcohols by electrochemical reduction of nitro alcohols.

It is a further object of the invention to obtain a pure amino alcohol and a sulfuric acid solution that can be reused.

According to the process of the invention, outside of water, the only raw material consumed stoichiometrically is the nitro alcohol. The consumption of sulfuric acid is reduced to a minimum and in some cases can be zero. There is little or no discharge into the environment. Additionally, the conversion of the nitro derivative into amino derivative can reach 95–98% and in most cases is greater than 90%.

In addition, the reaction conditions make it impossible to form $(R)_2—N—CH_3$ by the Mannich reaction. These amines are often undesirable in the applications of amino alcohols, because of their physical properties and similar structure, which increases the difficulty and the cost of the operations of purification of the amino alcohols.

The reduction of the $R—NO_2$ group and the acid-amino derivative separation are accomplished by electroreduction in a sulfuric medium in three stages.

In the first stage, a four-electron reduction is performed which transforms $R—NO_2$ into R—NOH. This reduction of the nitro group is performed on a cathode made of a material having a strong hydrogen overpotential by treating a sulfuric aqueous solution of the nitro derivative. This reaction is effective on a cathode whose overpotential is moderately electronegative.

In the second stage, the 2-electron reduction of hydroxylamine into amine is performed on a cathode whose electronegative potential is higher in absolute value than before.

In the third stage, the sulfuric solution of amino alcohol obtained is subjected to a purification operation by electro-electrodialysis, then to an elimination of the water.

The two electrochemical reduction stages can be put into practice in a diaphragm cell consisting of a cation-exchange membrane (CEM) or anion-exchange membrane (AEM); the purification phase can be performed in the same apparatus or in a specific apparatus.

BRIEF DESCRIPTION OF DRAWING

The overall reactions put into practice and the transfers of materials are indicated on the following diagrams (unbroken lines: migration caused by the electric field——dotted lines: transfers by diffusion).

With this device, the flow of the current takes place because of the migration of the $H_3O_+$ under the influence of the, electric field of the $H_3O+$ causing a dilution of the catholyte. In the first stage, since the effectiveness of the current is complete, the four protons generated at the anode by oxidation of the water are consumed for the cathode reduction; there is no release of hydrogen. In the second stage, the effectiveness of the current is not complete and a portion of it will to be used for the reduction of protons into $H_2$. This consumption of protons will be compensated for by a higher production at the anode and a higher flow of $H_3O+$.

In any case, the ratio of optimum $H^+/RX$ acidity ($RX=RNO_2+RNHOH+RNH_2$) will be kept constant on the cathode side.

Actually, it is possible to operate on the concentration anode and cathode solutions so that the transfer by diffusion of a mole of $H_2SO_4$ is negligible. These concentrations will be selected as a function of the properties of the membrane used. However, an exchange of ions cannot be completely avoided, causing a transfer of the $R—NH_2OH^+$, $R—NH_3^+$ from the catholyte to the anolyte.

The diagram of the third stage shows an electro-electrodialysis apparatus equipped with an AEM diaphragm and with electrodes having a slight hydrogen overpotential and oxygen in which, because of the transfer of the $SO_4^=$ ions under the effect of the electric field and to the reduction of the cations on the cathode, the ions of the $R—NH_3^+$ type are destroyed and a pure aqueous solution of $R—NH_2$ is collected on the cathode side. On the anode side is a dilute solution of $H_2SO_4$ that can be recycled in the cathode compartment after addition of $RNO_2$.

The case of an AEM diaphragm cell can be diagrammed in a similar manner.

This use of AEM takes advantage of the specific properties of this membrane by using, on the one hand, its exchange sites to cause the passage of $SO_4^=$ from the cathode compartment to the anode compartment and thus to assure the flow of the electric current in the cell and on the other hand its dialysis properties which make possible a selective diffusion of the sulfuric acid.

Thus, during the first two stages, on the anode side an aqueous solution of sulfuric acid significantly more concentrated than the catholyte is used; the diffusion flow through the membrane of the anolyte to the catholyte thus balances the transport of $SO_4^-$ ions in reverse direction. A constant acid concentration can thus be maintained on the cathode side and the electrochemical reduction can always be performed on a solution in which the $H^+/RX$ molar ratio remains constant and at its optimum value particularly for the reduction of the hydroxylamine group into an amino group. ($RX=R—NO_2+R—NHOH+R—NH_2$).

Figure 1:
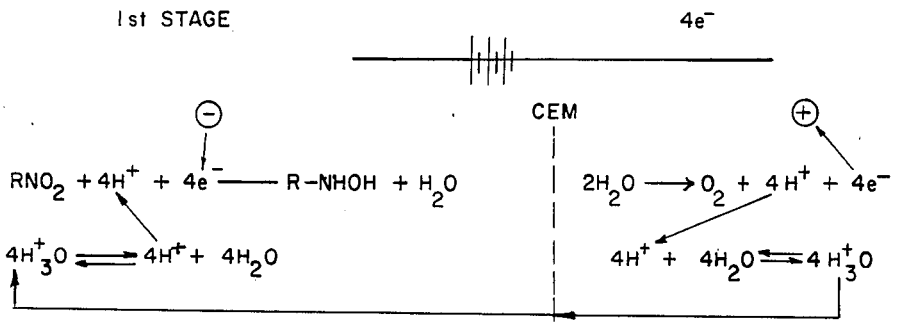
FIG. 1 shows the first stage of the process according to the present invention.
Figure 2:
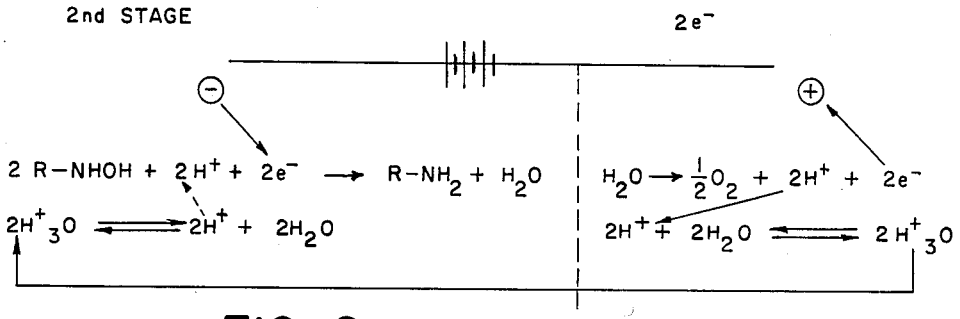
FIG. 2 shows the second stage of the process according to the present invention.
Figure 3:
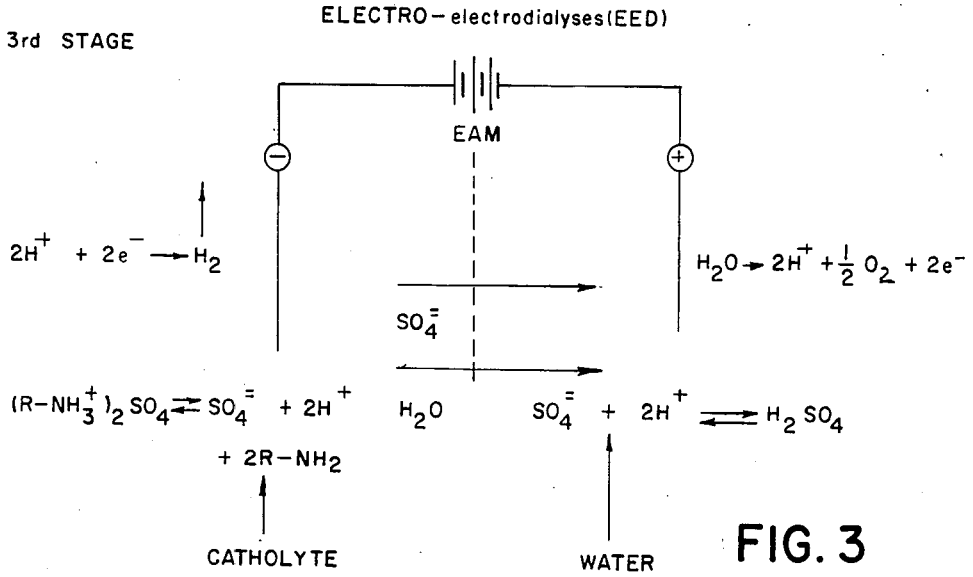
FIG. 3 shows the third stage of the process according to the present invention.
Figure 4:
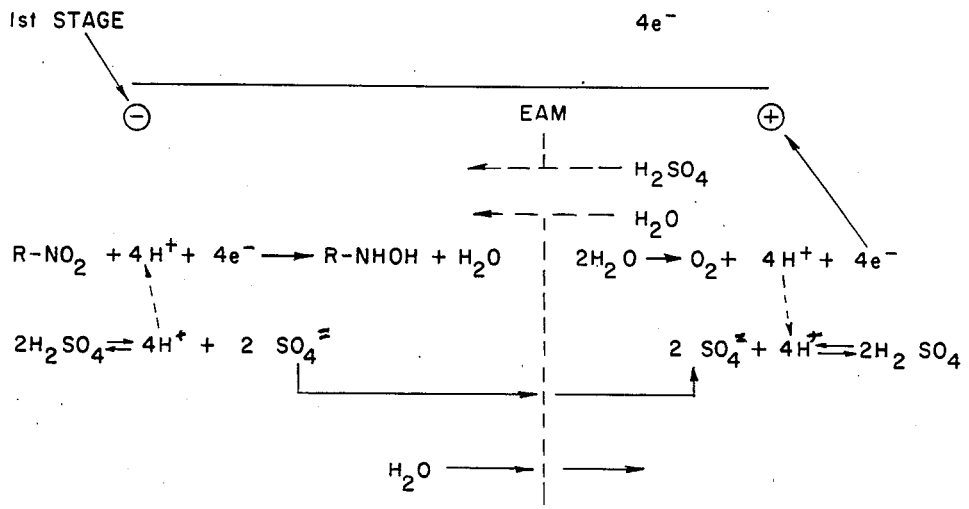
FIG. 4 shows the first stage of the process of the present invention wherein the cell is equipped with an anion exchange membrane diaphragm.
Figure 5:
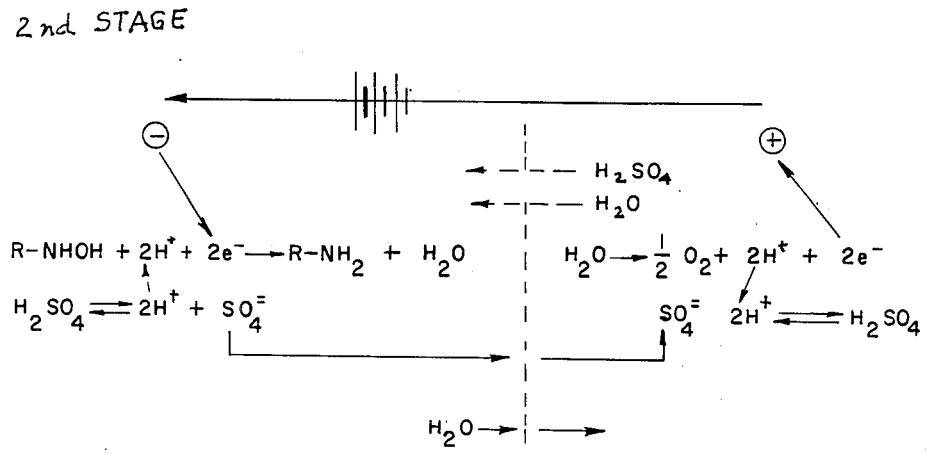
FIG. 5 shows the second stage of the process of the present invention wherein the cell is equipped with an anion exchange membrane diaphragm.

The final purification by electro-electrodialysis can be performed in a special device as shown in FIG. 1 (3rd stage) which differs from the AEM cell only by the nature of the electrode materials.

The final purification can also be put into practice in the cell that has been used for the embodiment of the electrochemical reduction by replacing the anode concentrated sulfuric solution with pure water and by sending into the cell the amount of electricity necessary for the transfer of the $SO_4^=$ ions; the modification in the difference of sulfuric concentration on both side of the membrane cause the inversion of the diffusion current. As in the electro-electrodialysis apparatus (FIG. 1, 3rd stage), the transfer of solution water is performed in the catholyte-anaolyte direction and the strength of the catholyte is increased. However, since the cathode material for the electrochemical reduction is selected because of its strong hydrogen overpotential, the use of the reaction cell for the purification unnecessarily causes a consumption of additional energy.

Depending on the structure of the prepared products, the use of the AEM membrane can have the advantage of a stricter elimination of the transfer by ion exchange of the $R—NH_3^+$ and $R—Nh_2OH^+$ toward the anolyte; the anode compartment can also more easily be used for putting the oxidation reaction into practice. Nevertheless, in most cases, it is simpler and more convenient to perform the reduction operations in electrochemical cells equipped with an CEM diaphragm and the purification in an electro-electrodialysis apparatus equipped with an AEM diaphragm.

The process is applicable to the nitro alcohols represented by the formula

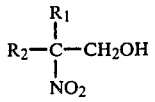

in which $R_1$ and $R_2$ together or separately are hydrogen, a hydroxyalkyl group, such as hydroxymethyl, or a linear or branched alkyl group, in particular, methyl, ethyl, propyl or containing a number of carbon atoms greater than three.

Among these products are found nitro products that lead to industrially important alkanolamines such as 2-nitro-2-methyl-1-propanol, 2-nitro-2-methyl-1,3-propanediol, 2-nitro-2-ethyl-1,3-propanediol, 2-nitro-1-butanol, tris(hydroxymethyl)nitromethane.

The cathode is made of a material that exhibits a strong hydrogen overpotential such as, for example, pure or alloyed lead, mercury in amalgam form (with copper, lead, zinc, etc.), zinc, zirconium, etc.

The anode is made of a chemically inert material in an anode solution and preferably having a slight oxygen overpotential such as, for example, Pb, ruthenium titanium, platinized Pt, etc.

The diaphragm is made with a commercial cation-exchange membrane or anion-exchange membrane such as, for example, those sold under the trademarks "Nafion" (Du Pont), "IONAC" (Ionac), "ARP" and "CRP" (Rhone Poulenc) or those marketed by ASAHI Chem Ind or ASAHI GLASS CO etc.

The cathode current density has the maximum value compatible with the potentials of electrodes that can be used and the properties of the membrane; with lead or mercury and an "IONAC" 3470 membrane, the operation can be performed under 50 $A/dm^2$ and above.

The temperature of the cathode solution can be between 20° C. and 100° C.; preferably the operation will be performed between 60° C. and 90° C. for the second stage, in the case where Pb cathodes are used and at 30° C. on amalgamated copper.

The catholyte is a sulfuric aqueous solution which can be saturated with nitro derivative; for 2-nitro-2-methylpropanediol the operation can be performed, for example, at 333 g/l (or 286 g/kg).

The $H_2SO_4$ content of the catholyte will be such that the molar ratio $$H^T/RNO_2$$

is between 1 and 1.5 preferably between 1.05 and 1.18.

The anolyte is an aqueous sulfuric acid solution; its composition will depend on the type and the properties of the membrane used and particularly on its permeability to sulfuric acid.

In the case of a cation-exchange diaphragm CEM, $H_2SO_4$ in the anolyte will have a value such that the migration flow by diffusion of $H_2SO_4$ is minimized as well as the transfer of organic cations by exchange of ions.

In the case of an anion-exchange diaphragm AEM $(H_2SO_4)_A$ in the anolyte has a such a value that the difference in concentration $(H_2SO_4)_A—(H_2SO_4)_C$ causes a balanced $H_2SO_4$ diffusion flow with the migration of the $SO_4^=$ ions under the effect of the electric field; this composition therefore will depend on the diffusion characteristics of the membrane, on the density of the current on the diaphragm, and on the concentration of $H^+$ (therefore of $R—NO_2$) of the catholyte.

The sulfuric solution of nitro alcohols used as catholyte can be prepared from solid products obtained by crystallization and purified by recrystallization.

The aqueous solution obtained by reaction of the nitroparaffin and formaldehyde can also be used; in this case, the procedure can be performed (for example) as follows:

In a stirred reactor, an aqueous solution of formaldehyde containing from 35 to 40% formaldehyde is placed; it is brought to 40° C. The pH is adjusted to 9 and the nitroparaffin is added drop by drop while maintaining the temperature between 40° and 50° C. and the pH at 9–10 by addition of an aqueous solution of 15N NaOH. At the end of an hour, the addition of nitroparaffin is completed. The mixture is stirred again for 1 hour at the same temperature while maintaining the pH greater than 9; the amount of nitro derivative is precisely stoichiometric or slightly in excess (1% molar) of the amount of formaldehyde.

The mixture is then acidified by $H_2SO_4$ to pH 5.

The catholyte can then be prepared by addition of $H_2SO_4$, and optionally $H_2O$, in such proportions that the composition of the final solution is in the ratio $H^+/R—NO_2$ corresponding to the optimum of the cathode reduction.

The process can be put into practice in an apparatus that makes possible a continuous or batch production.

DETAILED DESCRIPTION OF THE INVENTION

The following examples illustrate this invention in a nonlimiting way.

EXAMPLE 1

A multicellular electrolyzer comprising 3 cathode compartments that alternate with 4 anode compartments is used; the cathodes are lead plates whose useful surface that is immersed in the electrolyte is 72 $cm^2$ ($2\times36$ $cm^2$); the anodes are identical Pb plates.

The electrodes have undergone a preliminary degreasing with detergent then electronic pickling.

Electrochemical oxidation: 10 min in 4% $H_2SO_4$, 2 $A/dm^2$

Electrochemical reduction: 15 min in $H_2SO_4$

The compartments are separated by 6 diaphragms of 37.5 useful $cm^2$ cut from a membrane marketed under the trademark "IONAC 3475" consisting of a polypropylene support and anion-exchange sites of the quaternary ammonium type.

The 7 compartments are polypropylene frames 20 mm thick made solid by threaded rods; the fluid-tightness is obtained by polyvinyl chloride PVC seals; each compartment has a useful volume of 77 ml.

The cathode liquor is distributed in the three compartments from a thermal conditioning circuit consisting of a pump and a heat exchanger; this recirculation has the effect of causing the reaction medium to be stirred; the compartments are not equipped with turbulence promoters. The total volume of cathode liquor thus brought into play is 340 ml. The anode liquor is not stirred.

The catholyte contains 500 mmoles (67.6 g; 179.1 g/kg of 2-nitro-2-methyl-1,3-propanediol and 29 g of $H_2SO_4$ (7.7% by weight). The molar ratio $H^+/R—NO_2$ is therefore 1.186. The anolyte is an aqueous solution of 39% sulfuric acid.

The catholyte is brought to 50° C. and a cathode density of 10 $A/dm^2$ is established. The potential measured on the central cathode in relation to a saturated calomel electrode SEC, thanks to an assembly consisting of a capillary tube and a sintered glass in contact with the cathode, is in the vicinity of −0.6 V/SEC.

At the end of the first stage, the variation of the cathode potential is fast; the cathode liquor is then brought to 80° C. and the operation is continued with the same current density; the cathode potential takes a value in the vicinity of −1.5 V/SEC.

At the same time, the progress of the reaction is checked by potentiometric analysis of the cathode liquid which measures the contents of free acidity, R—NHOH and $R—NH_2$; a pH-metric semiquantitative test indicates the disappearance of $R—NO_2$. The variations in volume of the catholyte and of the anolyte to which water is optionally added are also measured.

At the end of the second stage, which is checked by chemical analysis (disappearance of the inflection point corresponding to R—NHOH on the potentiometric graph), the anode compartments that are filled immediately with pure water are emptied leaving the electrodes under potential; the interpolar potential increases greatly, then diminishes because of the progressive increase of acidity of the anolyte, goes beyond a minimum and again increases because of the reduction in conductivity of the catholyte caused by its gradual depletion of ions.

Finally, a cathode solution is collected that contains 1.57 mole/kg $R—NH_2$ (165 g/kg), 0.2 g $H_2SO_4$/kg. The content of nitro derivative and hydroxylamine is zero.

By dry evaporation under reduced pressure, a white precipitate is finally obtained that contains 99% 2-amino-2-methyl-1,3-propanediol (as determined by chromatography in vapor phase); its melting point is 108° C.

The overall yield in relation to the initial nitro derivative is greater than 95%; the effectiveness of the current is 67% for the electrochemical reduction. The total expenditure of energy (including the electrodialysis) is 11 kWh/kg.

The anode solution collected is a sulfuric aqueous solution containing 39% $H_2SO_4$, and it can be recycled. The agneous sulfuric acid solution collected after the electro-electrodialysis can be used partially on the cathode side after restoring the strength of $H_2SO_4$ and addition of a new charge of nitro derivative.

EXAMPLE 2

The same electrolyzer as in example 1 is used, but a sulfuric solution of tris(hydroxymethyl)nitromethane with a concentration of 1.068 moles/kg (161 g/kg) is treated; the concentration of $H_2SO_4$ is such that the ratio $H^+/R—NO_2=1.19$; the strength of the anolyte is 35.5% $H_2SO_4$.

The operation is performed with a cathode current density of 9 $A/dm^2$; the temperature of the catholyte is maintained at 50° C. for the first phase then brought to 80° C. for the second phase.

After electro-electrodialysis performed as in example 1, a pure solution of amine is obtained that no longer contains hydroxylamine or sulfuric acid; its strength is 1.171 moles/kg (142 g/kg).

The chemical yield in relation to the initial nitro derivative is 91% molar: the effectiveness of the current is 55%; the energy consumption is 8.6 kWh/kg for the electrolysis and 12.3 kWh/kg for the electrolysis-electro-electrodialysis together.

By dry evaporation of the catholyte, a solid white product testing 96% (dosage by chromatography in vapor phase) is collected.

EXAMPLE 3

A cell similar to the preceding one is used, but that has only one cathode compartment between two anode compartments; the cathode is Pb, the anodes of ruthenium titanium; the diaphragm is an anion-exchange membrane, marketed under the "IONAC" 3475 trademark.

The reduction of the 2-nitro-2-methyl-propanediol is performed by operating with a catholyte containing 1 mole/kg of nitro derivative; the operation is performed at 20 A/dm$^2$ at 80° C.; the ratio $H^+$/RX varies from 1.5 to 1.1 during the operation.

Before electrodialysis, a solution containing 0.880 mole/kg of 2-amino-2-methyl-1,3-propanediol is obtained.

The chemical yield in relation to the nitro derivative is 94.6%. The effectiveness of the current is 74.7%. The energy consumption is 7.8 kWh/kg. The solution obtained contains only amino alcohol and sulfuric acid and can very easily be purified and concentrated by electro-electrodialysis.

EXAMPLE 4

The operation is performed in the electrolytic cell used in example 3 in which the Pb cathode has been replaced with a cathode consisting of a Cu-Hg amalgam prepared by immersion for 10 minutes of a Cu plate 1 mm thick in a solution of mercuric sulfate (3%) and $H_2SO_4$ (10%).

A cathode current density of 10 A/dm$^2$ is used; the treated solution contains 0.737 mole/kg of 2-methyl-2-nitro-1,3-propanediol; it is maintained at 30° C.

Before the final purification treatment, an aqueous solution of 2-methyl-2-amino-1,3-propanediol and sulfuric acid is obtained. The effectiveness of the current is 80%. The chemical yield in relation to the nitro derivative is 97%.

EXAMPLE 5

The operation is performed on a three-compartment cell, identical with the one of example 3, except that it is equipped with a cation-exchange membrane diaphragm, marketed under the trademark "IONAC" MC 3470.

The reduction of the 2-nitro-2-methyl-1,3-propanediol obtained is performed in solution by addition of nitroethane to a solution of formaldehyde at 50° C., the pH being maintained at 9.5 by addition of a 15N sodium hydroxide solution. The concentration of the solution is then adjusted to 0.95 moles/kg of nitro derivative and 0.97 equivalent $H_2SO_4$/kg.

The operation is performed on a mercury (amalgamated copper) cathode at 30° C.; the current density is 10 A/dm$^2$ on the cathode and 9.6 A/dm$^2$ on the diaphragm.

After electrolysis, a solution is obtained that contains 0.831 mole/kg of amino alcohol and 0.867 equivalent $H_2SO_4$ per kg, from which the pure amino alcohol is very easily extracted by EED [electro-electrodialysis] and dry evaporation. The conversion of the nitro derivative into amino derivative is quantitative and the effectiveness of the cumulated current on the two stages of the electrochemical reduction is 80%; the energy consumption for the electrolysis is 9.8 kWh/kg of finished product.

EXAMPLE 6

The operation is performed with the same cell equipped with an CEM diaphragm on a rich mixture of 2-nitro-1-butanol, having the following composition:

2-nitro-1-butanol: 86% by weight
2-nitro-2-nitro-2-ethyl-1,3-propanediol: 11%
1-nitropropane: 1.5%
water: 1.5%

The reduction is performed on the amalgamated copper cathode at 10 A/dm$^2$ on the cathode and 9.6 A/dm$^2$ on the diaphragm. The temperature of the catholyte is 30° C.; it is an aqueous solution containing 1.075 mole/kg of nitro derivatives and 1.21 equ/kg $H_2SO_4$.

After electrolysis, a sulfuric aqueous solution containing 0.845 mole/kg of amino derivatives and 1.03 equ/kg $H_2SO_4$; a remainder of hydroxylamine function is metered in the solution representing only 2.5% molar of the organic products. By electro-electrodialysis EED and extraction of the water, an almost pure solution of amino alcohols will be obtained.

The overall effectiveness of the current is 75% and the expenditure of energy for electrolysis is 9 kWh/kg of amino derivatives; the chemical yield, in relation to the initial nitro derivatives, is 90.0%.

EXAMPLE 7

In the same cell as in the previous example, an aqueous solution of tris(hydroxymethyl)nitromethane is treated at 30° C. in sulfuric acid and containing 1.94 mole/kg of nitro derivative and 2.32 equ/kg $H_2SO_4$; the current density is 13.9 A/dm$^2$ on the cathode and 13.3 A/dm$^2$ on the diaphragm.

An aqueous solution is obtained that contains 1.134 mole/kg of tris(methylhydroxy)aminomethane, or 137 g/kg and 1.391 equ/kg $H_2SO_4$. Pure amino alcohol can easily be extracted by an EED treatment followed by a dry evaporation; the overall effectiveness of the electrolysis current is 65%.

It will thus be seen that the objects set forth above, among those made apparent from the proceding description, are efficiently attained. Since certain changes may be made in the examples set forth above without departing from the scope of the invention, it is intended that all matter contained in the above description shall be interpreted as merely illustrative and now limiting.

What is claimed is:

1. A process for producing amino alcohols by electrochemical reduction of nitro alcohols in an electrodialysis apparatus having an anode compartment containing an anolyte comprising a dilute solution of sulfuric acid and a cathode compartment containing catholyte, the anode compartment being separated from the cathode compartment by an ion exchange resin, comprising:

a. a first step of reacting a sulfuric acid solution of the nitro alcohol to form a hydroxylamine at the cathode, the cathode being made of a material having a strong hydrogen overpotential;

b. reducing the hydroxylamine from the first step at a cathode having a higher electronegative potential than the cathode in the first step to form an amino alcohol;

c. purifying the solution of amino alcohol produced by electroelectrodialysis and removing concentrated sulfuric acid present in the anode compartment by eliminating water therefrom.

2. The process of claim 1 wherein the nitroalcohol has the formula

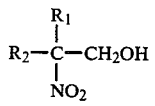

wherein $R_1$ and $R_2$ together or separately are hydrogen, hydroalkyl, or linear or branched chain alkyl.

3. The process of claim 2 wherein the nitro alcohol is selected from the group consisting of 2-nitro-2-methyl-1-propanol, 2-nitro-2-ethyl-1, 3-propanediol, 2-nitro-1-butanol, tris(hydroxymethyl)nitromethane, and 2-nitro-2 methyl 1,3-propanediol.

4. The process of claim 1 wherein the nitro alcohol is in the form of a solution obtained by the reaction of formaldehyde and a nitroparaffin analog of the nitro alcohol.

5. The process of claim 1 wherein the catholyte has a molar ratio of $H^+/R—NO_2$ from about 1 to about 1.5, and the temperature is between 20° and 100° C.

6. The process of claim 1 wherein the anode and cathode compartments are separated by a cation exchange membrane.

7. The process of claim 1 wherein the anode and cathode compartments are separated by an anion-exchange membrane.

8. The process of claim 1 wherein the electroelectrodialysis is performed in an apparatus wherein the anode has a slight oxygen overpotential and the cathode has a slight hydrogen overpotential, and the anode and cathode compartments are separated by a diaphragm consisting of an anion-exchange membrane.

9. The process of claim 1 wherein in the electroelectrodialysis apparatus for the electrodialysis step is fed in the cathode compartment by a sulfuric acid solution of amino alcohol and in the anode compartment by pure water.

10. The process of claim 1 wherein the catholylte is purified in an electrochemical reactor by replacing the concentrated sulfuric acid formed in the anode compartment by pure water.

11. The process of claim 1 wherein the cathode is made of a material selected from the group consisting of mercury, amalgam, lead and zirconium.

12. The process of claim 1 wherein the concentrated sulfuric acid comprising the anolyte is collected and recycled in the process.

13. The process of claim 1 wherein the dilute sulfuric acid solution collected at the anode compartment is reused in the cathode compartment with a new charge of nitro alcohol.

* * * * *